United States Patent [19]

Beremand et al.

[11] 4,087,962

[45] May 9, 1978

[54] DIRECT HEATING SURFACE COMBUSTOR

[75] Inventors: Donald G. Beremand, Bay Village; Lloyd I. Shure, Willowick; Thaddeus S. Mroz, Middleburg Heights, all of Ohio

[73] Assignee: The United States of America as represented by the Administrator of the National Aeronautics and Space Administration, Washington, D.C.

[21] Appl. No.: 708,660

[22] Filed: Jul. 26, 1976

[51] Int. Cl.[2] ..... F02C 7/22; F23D 13/14

[52] U.S. Cl. ..... 60/39.65; 431/7; 431/10; 431/328; 60/39.69 R

[58] Field of Search ..... 431/4, 7, 10, 328, 326, 431/329; 60/39.65, 39.55, 39.69

[56] References Cited

U.S. PATENT DOCUMENTS

| | | | |
|---|---|---|---|
| 822,491 | 6/1906 | Tonkin | 60/34.55 |
| 2,879,837 | 3/1959 | Downs | 431/328 |
| 3,161,227 | 12/1964 | Goss et al. | 431/328 |
| 3,191,659 | 6/1965 | Weiss | 431/328 |
| 3,199,568 | 8/1965 | Baumanns et al. | 431/328 |
| 3,672,839 | 6/1972 | Moore | 431/7 |
| 3,789,805 | 2/1974 | Williams | 431/10 |
| 3,805,763 | 4/1974 | Cowan | 431/329 |
| 3,899,031 | 8/1975 | Laessig | 431/328 |

FOREIGN PATENT DOCUMENTS

| | | | |
|---|---|---|---|
| 488,709 | 7/1938 | United Kingdom | 431/328 |

*Primary Examiner*—Robert E. Garrett

*Attorney, Agent, or Firm*—James A. Mackin; John R. Manning; Norman T. Musial

[57] ABSTRACT

A direct heating surface combustor is provided that utilizes a non-adiabatic flame to provide a low-emission combustion for gas turbines. A fuel-air mixture is directed through a porous wall, the other side of which serves as a combustion surface. A radiant heat sink disposed adjacent to and spaced from the combustion surface controls the combustor flame temperature in order to prevent the formation of oxides of nitrogen. A secondary air flow cools the heat sink. Additionally, up to 100% of secondary air flow is mixed with the combustion products at the direct heating surface combustor to dilute such products thereby reducing exit temperature. However, if less than 100% secondary air is mixed at the combustor, the remainder may be added to the combustion products further downstream.

3 Claims, 3 Drawing Figures

DIRECT HEATING SURFACE COMBUSTOR

ORIGIN OF THE INVENTION

The invention described herein was made by an employee of the United States Government and may be manufactured or used by or for the Government without the payment of any royalties thereon or therefor.

BACKGROUND OF THE INVENTION

1. Field of the Invention

This invention relates to direct heating surface combustors for gas turbines and, more particularly, to an improved combustor which provides low emissions.

2. Description of the Prior Art

Conventional gas turbine combustors generally have a primary combustion zone that provides burning at or near the stoichiometric fuel-air ratio. In a secondary zone following the primary zone excess air is utilized as a diluent to achieve the desired turbine inlet temperature. Products of combustion produced by such combustors contain relatively high quantities of the oxides of nitrogen ($NO_x$) because the primary flame is nearly adiabatic and the temperatures utilized are high. With the growing interest in control of our pollution such $NO_x$ emissions are becoming increasingly unacceptable.

Examples of essentially adiabatic combustors which provide cooling through the use of injected air, water or exhaust gases are found in U.S. Pat. Nos. 3,088,280; 3,541,790 and 3,440,818. U.S. Pat. No. 3,322,179 discloses a radiant surface combustor of general interest.

SUMMARY OF THE INVENTION

The combustor of the present invention, unlike conventional gas turbine combustors, utilizing secondary zone cooling, provides for the cooling of the flame during the combustion process through the provision of a radiant heat sink and secondary air flow. This cooling provides for a low flame temperature thereby resulting in low $NO_x$ emissions.

In accordance with a preferred embodiment thereof, the direct heating surface combustor of the invention includes a porous plate burner having a first surface against which the fuel-air mixture is applied and a second, opposed surface which provides a situs for combustion. A radiant heat sink is disposed adjacent the second surface of the burner so as to remove radiant energy produced by the combustion of the fuel-air mixture and thereby enable operation below the adiabatic temperature. Consequently, the combustor operates near the stoichiometric mixture ratio but at a temperature low enough to avoid excessive $NO_x$ emissions. Secondary air, which flows through and hence cools the radiant heat sink is introduced adjacent the combustion surface to provide mixing with the combustion products. The flow rate of the secondary air relative to the flow of the air-fuel mixture is used to determine the exit temperature of the combustion products. The radiant heat sink preferably comprises a plurality of tubes disposed adjacent the plate burner. To provide additional cooling as required, the secondary air can be directed through the tubes towards the flame to cause cooling thereof by direct convection and mixing. Also, the secondary air tubes can be positioned to contact the flame and thus provide direct heat transfer. In another embodiment, the radiant heat sink comprises a further porous plate.

Additional features and advantages of the invention will be set forth in, or apparent from, the detailed description of the preferred embodiments of the invention found hereinbelow.

DETAILED DESCRIPTION OF THE PREFERRED EMBODIMENT

Figure 1:
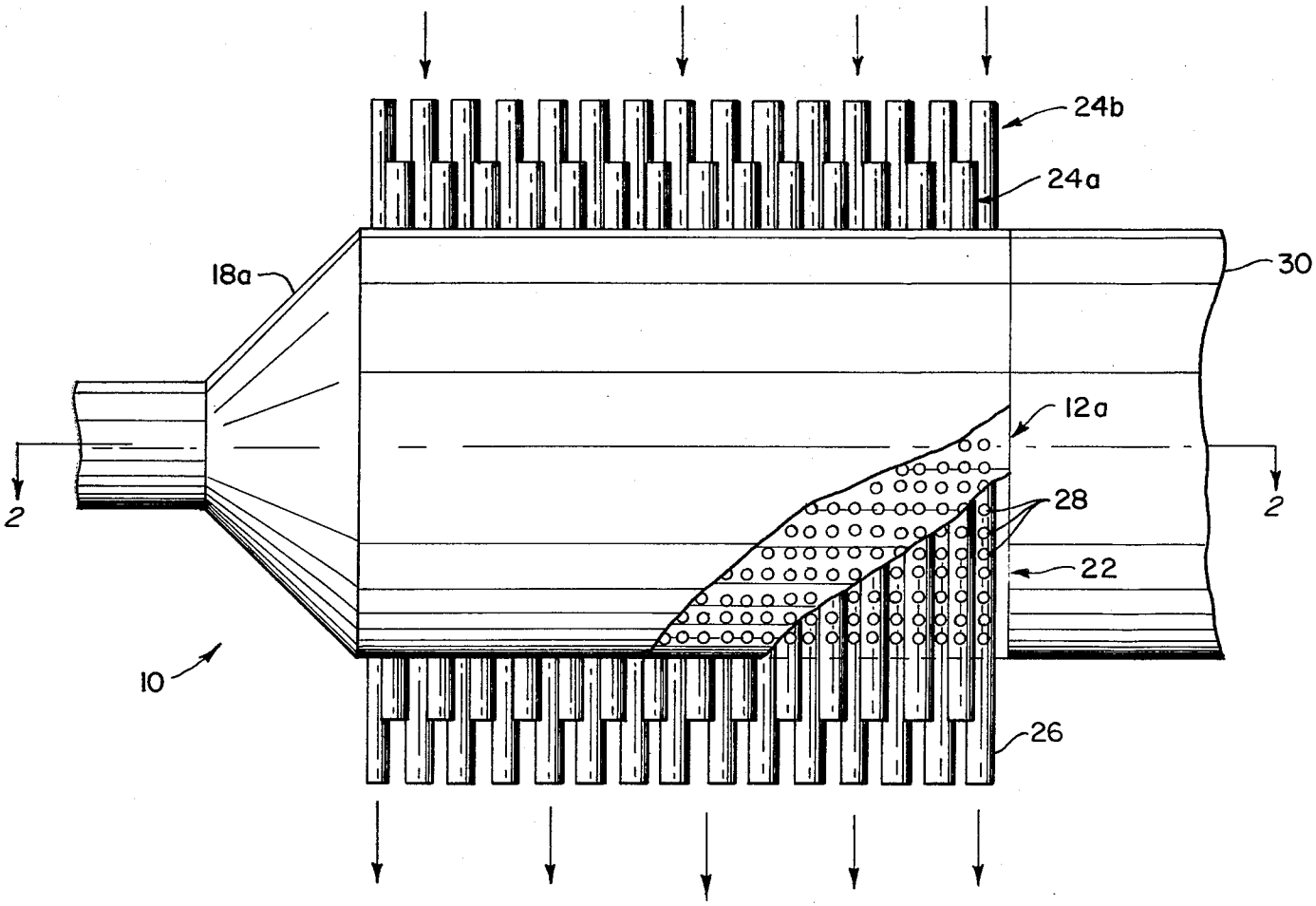
FIG. 1 is a plan view of a surface combustor, in accordance with the invention, with a portion thereof cut away.
Figure 2:
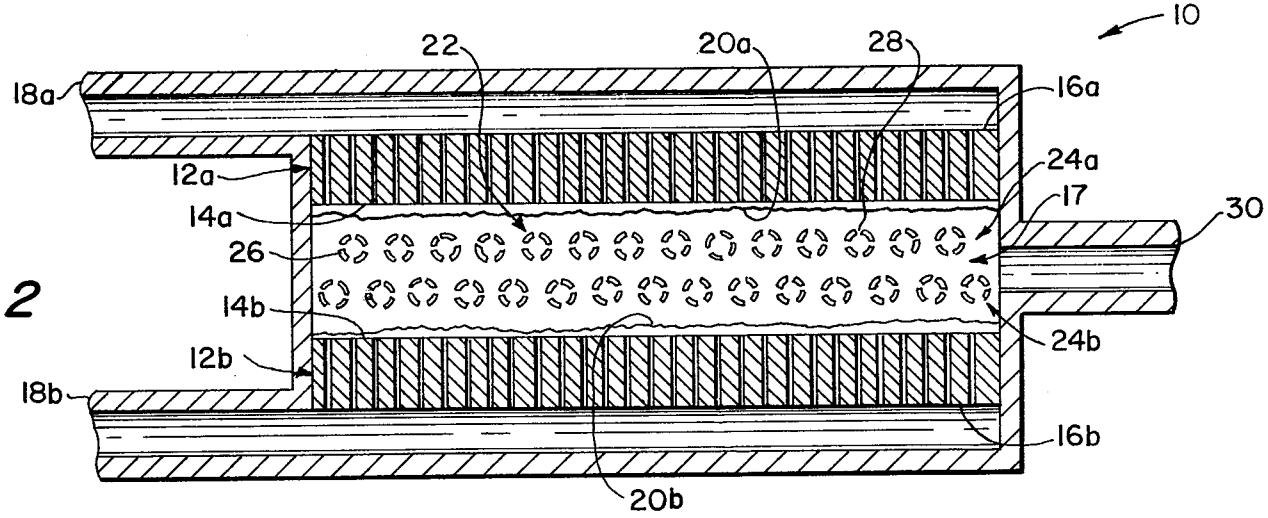
FIG. 2 is a cross-sectional view taken along line 2—2 of FIG. 1.

Referring to FIGS. 1 and 2, there is depicted a preferred embodiment of direct heating surface combustor 10. Surface combustor 10 includes a first porous flat-plate burner **12*a* and a second porous flat-plate burner 12*b* generally parallel thereto. Burners 12*a* and 12*b*** can be comprised of, for example, ceramics or sintered metals, or any other porous material suitable for use in a surface combustor.

Burner **12*a* includes first and second generally parallel surfaces 14*a* and 16*a* and burner 12*b* includes first and second generally parallel surfaces 14*b* and 16*b*. Burner surface 14*a* faces, and is spaced apart from surface 14*b* so as to form two walls of a combustion chamber 17. A pair of burner ducts 18*a* and 18*b* supply a premixture of fuel and air to burner surfaces 16*a* and 16*b*. The fuel-air mixture penetrates the porous burners 12*a* and 12*b*, emerging from first surfaces 14*a* and 14*b* to establish flame fronts indicated at 20*a* and 20*b***, respectively.

Located within combustion chamber 17 between spaced surfaces **14*a* and 14*b* is a radiant heat sink 22. Heat sink 22 includes first and second tiers or layers 24*a* and 24*b* each composed of a plurality of individual tubes 26. Tubes 26 are generally parallel to each other and tube layers 24*a* and 24*b* are generally parallel to first burner surfaces 14*a* and 14*b*, tubes 26 being oriented so as to be generally perpendicular to ducts 18*a* and 18*b***.

Tubes 26 can be comprised of, for example, a porous material, or tubular stock with perforations therein. In the embodiment illustrated, tubes 26 have a series of perforations 28 therein. At least some of the perforations 28 face first surface **14*a* and 14*b*. Secondary air from a suitable source (not shown) passes through tubes 26 in the direction indicated by the arrows in FIG. 1. A percentage, up to 100%, of this secondary air enters combustion chamber 17 through perforations 28, (combustion chamber 17 being in fluid communication with the gas turbine through exhaust port 30**).

The operation of a low pressure, surface combustor 10 as contemplated for use with a closed cycle engine will now be considered. Premixed fuel-air in the combustible range is supplied to porous burner **12*a* and 12*b* through ducts 18*a* and 18*b* as described hereinbefore. Premixing of fuel and air is required before the fuel and air enters porour burners 12*a* and 12*b* in that premixing tends to insure uniform fuel concentration and provides intimate fuel-air contact which are important factors for low combustion emissions. The fuel-air mixture emerges from burners 12*a* and 12*b* and feeds non-adiabatic flame fronts 20*a* and 20*b*. The flame fronts are uniform across burner surfaces 14*a* and 14*b* and are generally less than 4 millimeters high. Combustion occurs near the stoichiometric fuel-air ratio. Combustion temperatures are heat-transfer controlled below 3000° F by conductive heat transfer to burner surfaces 14***a* and 14*b* which in turn radiate heat to heat sink 22. Tubes 26 of sink 22 are cooled by heat convection to the secondary air that flows therethrough. The lower resultant flame temperature minimizes $NO_x$ formation.

As previously discussed, up to 100% of the secondary air passes through perforations 28 and mixes with the combustion products thereby lowering combustor exit temperature. The embodiment of FIGS. 1 and 2 provides additional flame cooling since at least some perforations 28 face flame fronts 20*a* and 20*b* so that some secondary air is directed at the flame. The flame is thus cooled by direct convection and mixing.

Alternatively, the fuel-air mixture can be supplied to burners 12*a* and 12*b* with excess air. This excess air lowers the adiabatic flame temperature. However, in order that the discharge temperature is maintained, less secondary air flow is available to cool the flame.

Figure 3:
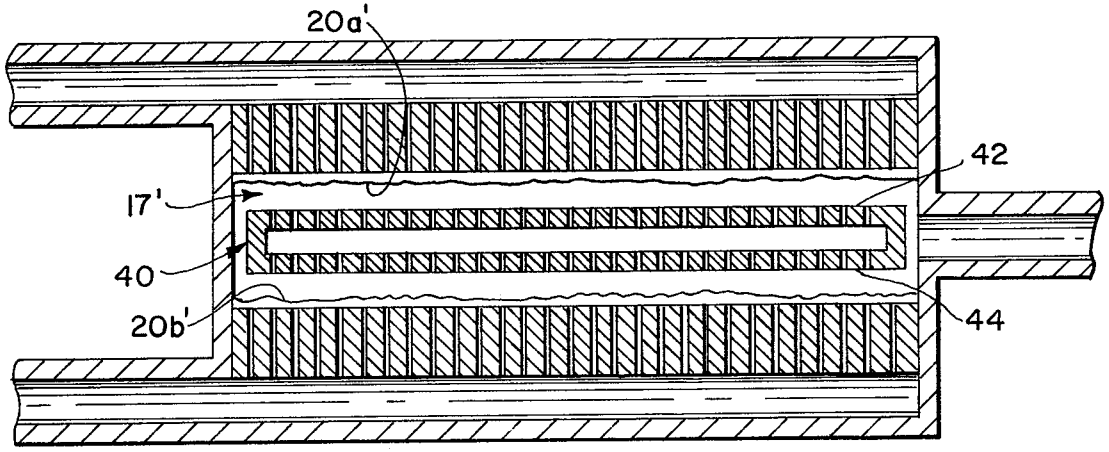
FIG. 3 is a cross-sectional view of another embodiment of a surface combustor in accordance with the invention.

An alternate embodiment of the surface combustor in accordance with the invention is depicted in FIG. 3. The embodiment of FIG. 3 is similar to that of FIGS. 1 and 2 and like elements have been given the same numerals with primes attached. The embodiment of FIG. 3 differs from the embodiment of FIGS. 1 and 2 in the construction of the radiant heat sink utilized. In FIG. 3, a radiant heat sink 40 is employed which is comprised of a hollow rectangular member that includes generally parallel porous surfaces 42 and 44 which face flame fronts 20*a'* and 20*b'*, respectively. Radiant heat sink 40 can, for example, be fabricated of ceramic or sintered metals. A portion of the secondary air traveling through sink 40 passes through porous surfaces 42 and 44 into the combustion chamber 17' in a manner similar to that described above in connection with FIGS. 1 and 2.

As noted above, the secondary flow tubes shown in FIGS. 1 and 2 can be disposed in direct contact with the flame front to provide direct heat transfer from the flame to the flow tubes. In the extreme, the secondary flow tubes can be integrated directly into the surface of the porous plate-type burner.

Further, the flat porous burner plates can be replaced by burners having cylindrical or polygonal configurations.

In accordance with another embodiment, a combustor is used which comprises small burner modules which enables fuel staging to be achieved. Using fuel staging and control of the fuel-air ratio, good emission performance can be achieved over a range of power.

The direct heating surface combustor described above has applications as an external, low-pressure, combustor for use with closed-cycle heat engines. Additionally, the surface combustor has applications in, for example, semi-closed Brayton engines for guideway vehicles and buses. Further, the combustor can be adopted to a semi-closed Rankine cycle engine, which uses recirculated water instead of air as the secondary flow. Also, by using natural gas as fuel, such surface combustors can be used in various industrial applications. Liquid fuel can be used with surface combustors in advanced automotive engines.

Although the present invention has been described relative to an exemplary embodiment thereof, it will be understood by those skilled in the art that variations and modifications can be effected in these embodiments without departing from the scope and spirit of the invention.

We claim:

1. A direct heating, gas turbine, surface combustor for producing a primary flow of gases with low-emission products, said combustor comprising:

first and second porous plate burners each having a first surface against which a fuel-air mixture is directed and a second, opposed surface for providing a combustion situs, said first and second burners being spaced apart to define a combustion chamber therebetween;

a radiant heat sink disposed within said combustion chamber in proximity to the said second surface of each of said first and second burners, said radiant heat sink including a first porous wall and a second porous wall generally parallel to said first porous wall, said first porous wall being disposed adjacent said first burner and said second porous wall being adjacent said second burner, and means for directing up to 100% of a secondary air flow through said heat sink to provide cooling thereof and dilution of combustor exhaust products.

2. A combustor in accordance with claim 1 wherein said radiant heat sink and said burner are comprised of sintered metals.

3. A combustor in accordance with claim 1 wherein said burner is comprised of a ceramic material.

* * * * *